US011891866B2

(12) United States Patent
Passmore et al.

(10) Patent No.: US 11,891,866 B2
(45) Date of Patent: Feb. 6, 2024

(54) DAMPENING THE ACTUATION SPEED OF A DOWNHOLE TOOL

(71) Applicant: HALLIBURTON ENERGY SERVICES, INC., Houston, TX (US)

(72) Inventors: Kevin Robin Passmore, Dallas, TX (US); Bruce Edward Scott, McKinney, TX (US); James D. Vick, Jr., Mineral Wells, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/374,088

(22) Filed: Jul. 13, 2021

(65) Prior Publication Data

US 2023/0014780 A1 Jan. 19, 2023

(51) Int. Cl.

| | |
|---|---|
| ***E21B 23/00*** | (2006.01) |
| ***E21B 34/06*** | (2006.01) |
| ***E21B 41/00*** | (2006.01) |

(52) U.S. Cl.

CPC ..... *E21B 23/00* (2013.01); *E21B 34/06* (2013.01); *E21B 41/00* (2013.01)

(58) Field of Classification Search

CPC ..... E21B 23/00; E21B 34/06; E21B 41/00
See application file for complete search history.

(56) References Cited

U.S. PATENT DOCUMENTS

| | | | | |
|---|---|---|---|---|
| 4,638,895 | A | 1/1987 | Taylor et al. | |
| 5,050,681 | A * | 9/1991 | Skinner | E21B 41/00 166/66.4 |
| 7,487,829 | B2 | 2/2009 | McDonald et al. | |
| 2012/0205122 | A1 * | 8/2012 | Peter | E21B 34/085 166/321 |
| 2012/0228029 | A1 | 9/2012 | Reimers | |

(Continued)

FOREIGN PATENT DOCUMENTS

| | | | |
|---|---|---|---|
| CN | 108019171 | A | 5/2018 |

OTHER PUBLICATIONS

"Labyrinth seal," Web page Wikipedia, <www.en.wikipedia.com>, 2 pages, retrieved from the Internet <http. https://en.wikipedia.org/wiki/Labyrinth_seal>, on May 14, 2021.

(Continued)

*Primary Examiner* — Brad Harcourt

(74) *Attorney, Agent, or Firm* — Scott Richardson; Parker Justiss, P.C.

(57) ABSTRACT

An actuator of a downhole tool used in oil and gas exploration and production operations is operable to actuate a first implement in a first direction. A biasing device of the downhole tool is operable to actuate the first implement in a second direction, opposite the first direction. A dampener of the downhole tool is operable to slow an actuation speed of the first implement in the first direction, the second direction, or both. Actuating the first implement in the first direction also actuates a second implement of a flow control device ("FCD") of the downhole tool, to which the first implement is connected, in the first direction, placing the FCD in a first (e.g., open) configuration. Actuating the first implement in the second direction also actuates the second implement of the FCD in the second direction, placing the FCD in a second (e.g., closed) configuration.

15 Claims, 7 Drawing Sheets

(56) References Cited

U.S. PATENT DOCUMENTS

| | | | | |
|---|---|---|---|---|
| 2013/0327537 | A1* | 12/2013 | Anyan | E21B 34/102 166/373 |
| 2015/0211333 | A1 | 7/2015 | Vick, Jr. et al. | |
| 2016/0258252 | A1* | 9/2016 | Fripp | E21B 34/10 |
| 2018/0238131 | A1* | 8/2018 | Mackenzie | E21B 23/006 |
| 2018/0347313 | A1* | 12/2018 | Joseph | E21B 34/066 |
| 2019/0242211 | A1 | 8/2019 | Vasques | |

OTHER PUBLICATIONS

"Labyrinth seal review," Web page <www.engineersedge.com>, 2 pages, retrieved from the Internet <https://www.engineersedge.com/fluid_flow/labyrinth-seal-concept.htm#:~:text=Labyrinth%20Seal%20Review%20%2D%20Engineers%20Edge&text=A%20labyrinth%20seal%20is%20a,the%20oil%20lubricating%20the%20bearingon>, on May 14, 2021.

International Search Report and The Written Opinion of the International Search Authority, or the Declaration, Nov. 2, 2021, PCT/US2021/041412, 10 pages, ISA/KR.

* cited by examiner

DAMPENING THE ACTUATION SPEED OF A DOWNHOLE TOOL

TECHNICAL FIELD

The present disclosure relates generally to downhole tools for use in oil and gas exploration and production operations and, more particularly, to dampening the actuation speed of a downhole tool.

BACKGROUND

In some instances, it is desirable to dampen the actuation speed of a downhole tool. For example, when a downhole tool uses a powerful actuation mechanism, such as a spring, dampening the actuation speed may be necessary to ensure proper actuation of the downhole tool without damaging the downhole tool or other systems/devices associated with the downhole tool.

DETAILED DESCRIPTION

Figure 1:
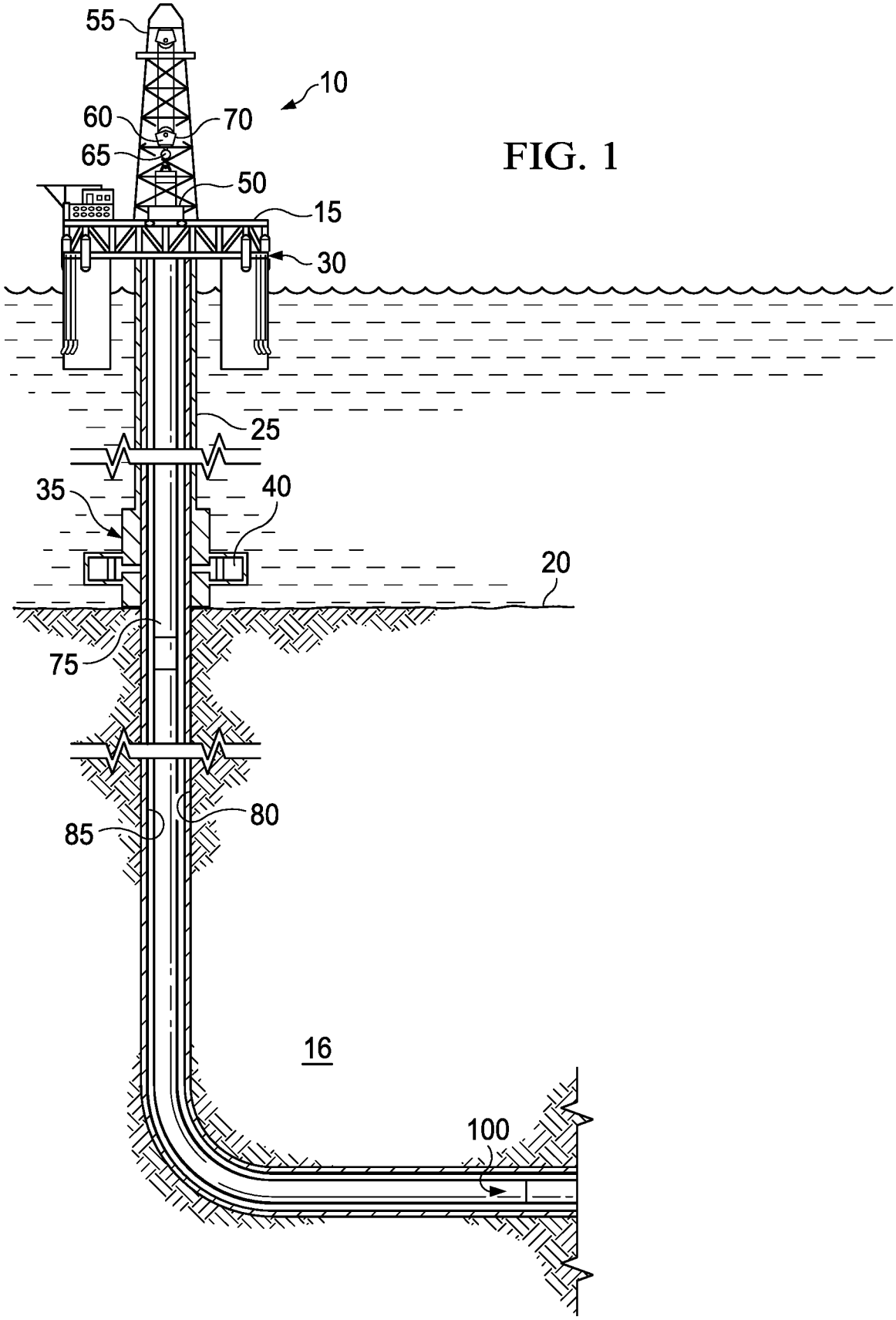
FIG. 1 is a schematic illustration of an offshore oil and gas platform connected to a downhole tool, according to one or more embodiments.

The disclosure may repeat reference numerals and/or letters in the various examples or figures. This repetition is for simplicity and clarity and does not in itself dictate a relationship between the various embodiments and/or configurations discussed. Further, spatially relative terms, such as beneath, below, lower, above, upper, uphole, downhole, upstream, downstream, and the like, may be used herein for ease of description to describe one element or feature's relationship to another element(s) or feature(s) as illustrated, the upward direction being toward the top of the corresponding figure and the downward direction being toward the bottom of the corresponding figure, the uphole direction being toward the surface of the wellbore, the downhole direction being toward the toe of the wellbore. Unless otherwise stated, the spatially relative terms are intended to encompass different orientations of the apparatus in use or operation in addition to the orientation depicted in the figures. For example, if an apparatus in the drawings is turned over, elements described as being "below" or "beneath" other elements or features would then be oriented "above" the other elements or features. Thus, the exemplary term "below" can encompass both an orientation of above and below. The apparatus may be otherwise oriented (i.e., rotated 90 degrees) and the spatially relative descriptors used herein may likewise be interpreted accordingly.

Referring to FIG. 1, in an embodiment, an offshore oil and gas rig is schematically illustrated and generally referred to by the reference numeral 10. In an embodiment, the offshore oil and gas rig 10 includes a semi-submersible platform 15 that is positioned over a submerged oil and gas formation 16 located below a sea floor 20. A subsea conduit 25 extends from a deck 30 of the platform 15 to a subsea wellhead installation 35. One or more pressure control devices 40, such as, for example, blowout preventers (BOPs), and/or other equipment associated with drilling or producing a wellbore may be provided at the subsea wellhead installation 35 or elsewhere in the system. The platform 15 may also include a hoisting apparatus 50, a derrick 55, a travel block 60, a hook 65, and a swivel 70, which components are together operable for raising and lowering a conveyance string 75. The conveyance string 75 may be, include, or be part of, for example, a casing, a drill string, a completion string, a work string, a pipe joint, coiled tubing, production tubing, other types of pipe or tubing strings, and/or other types of conveyance strings, such as wireline, slickline, and/or the like. The platform 15 may also include a kelly, a rotary table, a top drive unit, and/or other equipment associated with the rotation and/or translation of the conveyance string 75. A wellbore 80 extends from the subsea wellhead installation 35 and through the various earth strata, including the submerged oil and gas formation 16. In some embodiments, as in FIG. 1, at least a portion of the wellbore 80 includes a casing 85 cemented therein. A downhole tool 100 extends within the wellbore 80 and is connected to the conveyance string 75.

Figure 2A:
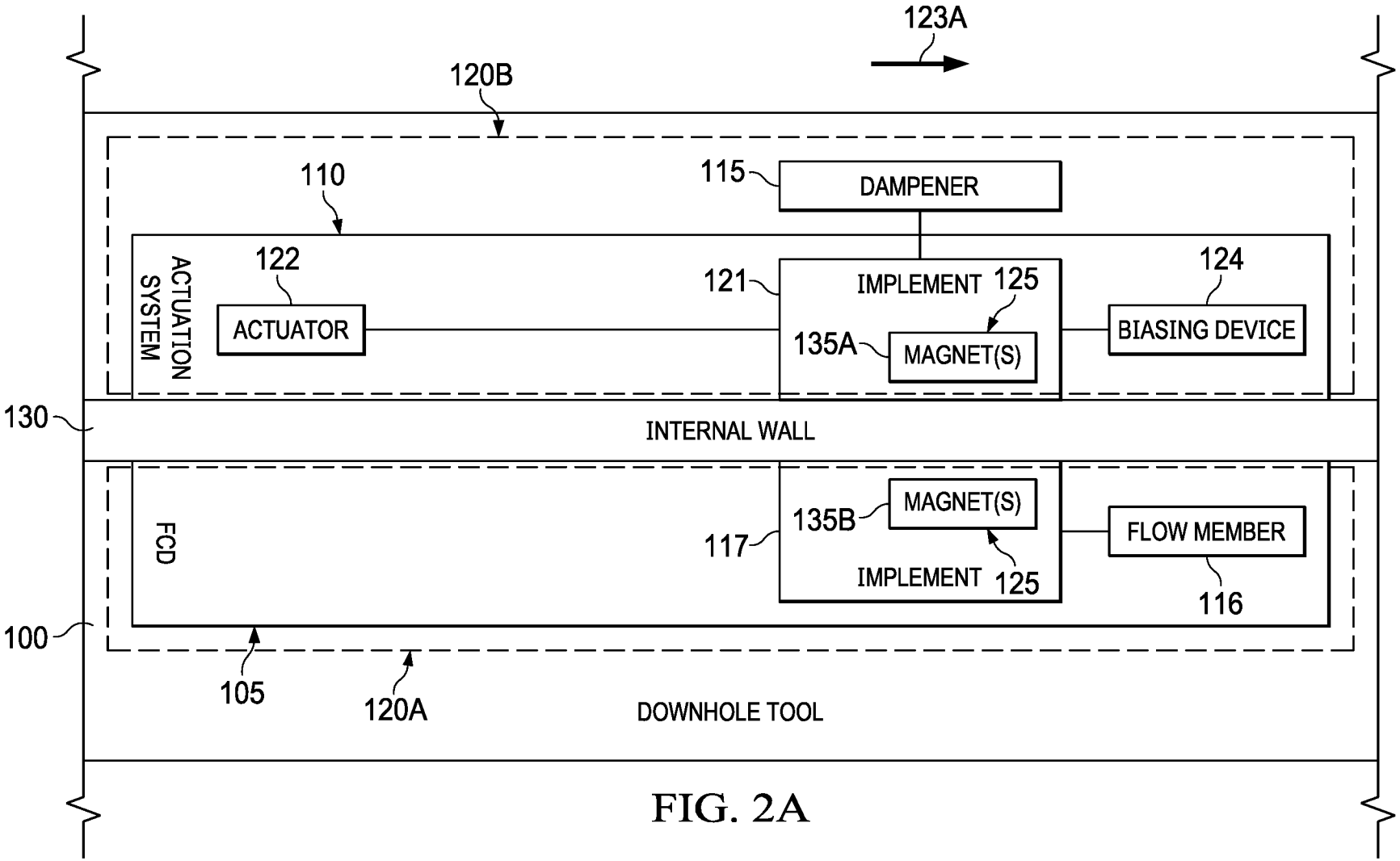
FIG. 2A is a diagrammatic illustration of the downhole tool of FIG. 1 in a first operational state or configuration, the downhole tool including an actuation system, a flow control device, and a dampener, according to one or more embodiments.
Figure 2B:
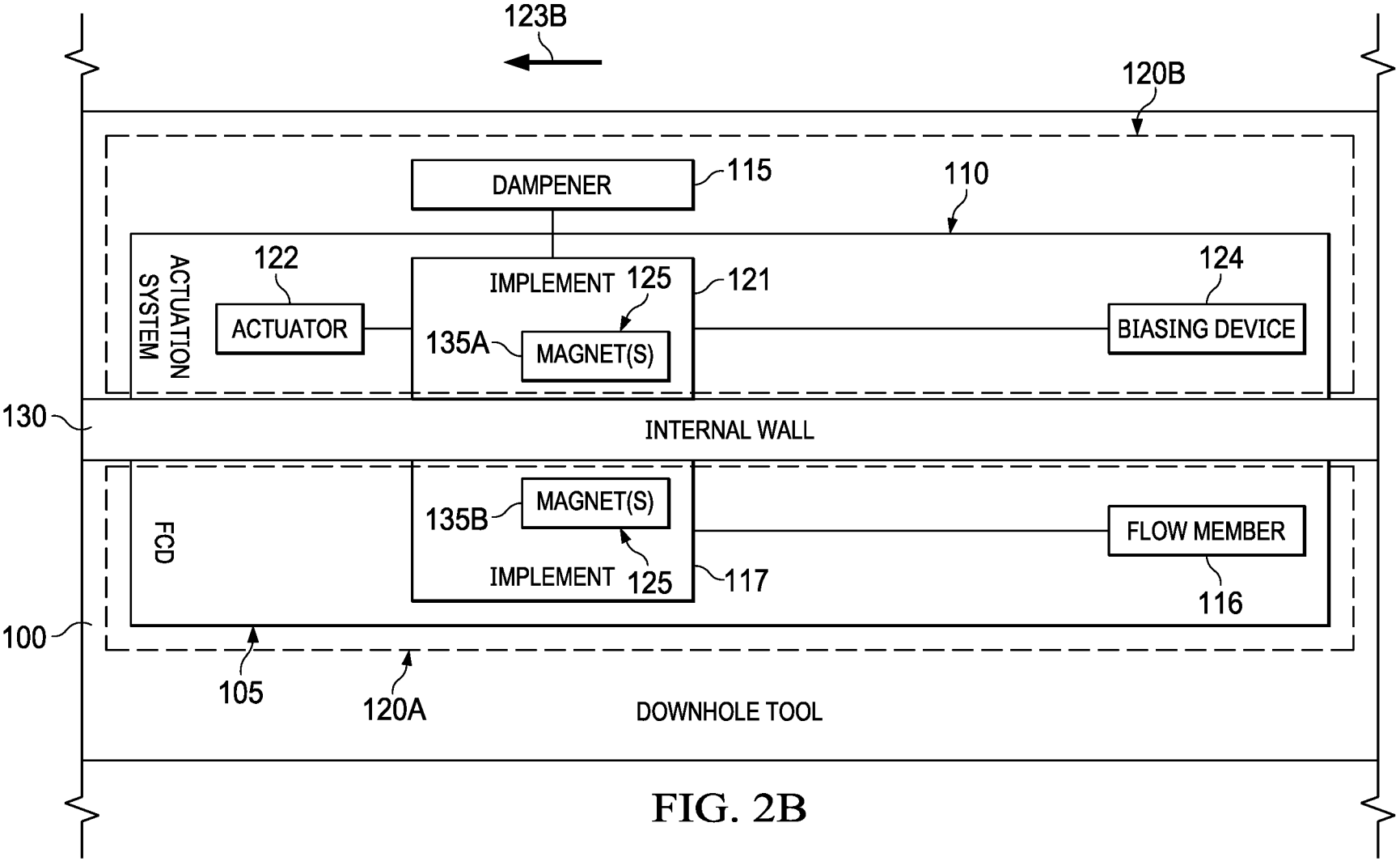
FIG. 2B is a diagrammatic illustration of the downhole tool of FIG. 1 in a second operational state or configuration, according to one or more embodiments.

Referring to FIGS. 2A and 2B, in an embodiment, the downhole tool 100 includes a flow control device ("FCD") 105, an actuation system 110, and a dampener 115. The FCD 105 includes a flow member 116 and an implement 117 via which the actuation system 110 is adapted to move the flow member 116 between first (e.g., open or partially-open) and second (e.g., closed) configurations, as will be described in further detail below. The FCD 105 is disposed within an internal space 120*a* of the downhole tool 100; for example, the FCD 105 may be disposed within a central flow passage of the downhole tool 100. In one or more embodiments, the FCD 105 is or includes a subsurface safety valve ("SSSV"). In addition, or instead, the FCD 105 may be or include flow control device such as, for example, a valve (e.g., a flapper valve, a gate valve, a ball valve, a plug valve, the like, another type of valve, or a combination thereof), another (at least partially) translationally actuable flow control device (e.g., a plug, a packer, etc.), the like, or a combination thereof.

The actuation system 110 is disposed within an internal space 120*b* of the downhole tool 100. In one or more embodiments, the internal space 120*b* of the downhole tool 100 in which the actuation system 110 is disposed is external to the internal space 120*a* in which the FCD 105 is disposed; for example, the internal space 120*b* may be an annular space external to the central flow passage in which the FCD 105 is disposed. Alternatively, the internal space 120*b* of the downhole tool 100 in which the actuation system 110 is disposed may be, include, or overlap with the internal space 120*a* of the downhole tool 100 in which the FCD 105 is disposed. The actuation system 110 includes an implement 121, an actuator 122 operable to move the implement 121 in a direction 123*a*, and a biasing device 124 (e.g., a spring, a hydraulic or pneumatic device, the like, etc.) operable to move the implement 121 in a direction 123*b*, opposite the direction 123*a*. In one or more embodiments, the actuator 122 is or includes an electric motor. In addition, or instead, the actuator 122 may be or include another source of mechanical energy (e.g., hydraulic, pneumatic, the like, etc.) capable of moving the implement 121 in the direction 123*a*.

A coupler 125 connects the implement 121 of the actuation system 110 to the implement 117 of the FCD 105. In one or more embodiments, the coupler 125 is or includes a magnetic coupler connecting the implement 121 of the actuation system 110 to the implement 117 of the FCD 105 through an internal wall 130 (e.g., a tubular wall, such as a cylindrical wall) of the downhole tool 100, which internal wall 130 separates the internal space 120*a* in which the FCD 105 is disposed from the internal space 120*b* in which the actuation system 110 is disposed; in such embodiment(s), the coupler 125 includes magnetic devices 135*a* and 135*b* connected to or otherwise associated with or incorporated into the implement 121 of the actuation system 110 and the implement 117 of the FCD 105, respectively, which magnetic devices 135*a* and 135*b* are magnetically coupled to one another through the internal wall 130 of the downhole tool 100. Alternatively, the coupler 125 may be omitted and the implement 121 may be integrally formed with, or otherwise connected to the implement 117. The dampener 115 is connected to the implement 121 of the actuation system 110 to slow the actuation speed of the downhole tool 100 in the direction 123*a*, the direction 123*b*, or both. In one or more embodiments, the dampener 115 is disposed within the internal space 120*b* of the downhole tool 100, together with the actuation system 110. Alternatively, the dampener 115 may be connected to the implement 117 of the FCD 105 to slow the actuation speed of the downhole tool 100 in the direction 123*a*, the direction 123*b*, or both. In one or more embodiments, the dampener 115 is disposed within the internal space 120*a* of the downhole tool 100, together with the FCD 105.

In operation, the actuation system 110 is movable in the direction 123*a* to actuate the FCD 105; for example, the implement 121 of the actuation system 110 may be movable using the actuator 122, in the direction 123*a*, to move the implement 117 of the FCD 105 in the direction 123*a* (via the coupler 125), thereby opening (or closing) the flow member 116 to allow fluid flow through the internal space 120*a*. The biasing device 124 accumulates potential energy during the movement of the implement 121 in the direction 123*a*. In one or more embodiments, the dampener 115 slows the actuation speed of the implement 121 in the direction 123*a*, as will be described in further detail below. Similarly, the actuation system 110 is movable in the direction 123*b* to actuate the FCD 105; for example, the implement 121 of the actuation system 110 may be movable using the biasing device 124, in the direction 123*b* (via the coupler 125), to move the implement 117 of the FCD 105 in the direction 123*b*, thereby closing (or opening) the flow member 116 to block fluid flow through the internal space. The potential energy accumulated in the biasing device 124 during the movement of the implement 121 in the direction 123*a* is released as kinetic energy to move the implement 121 in the direction 123*b*. In one or more embodiments, the dampener 115 slows the actuation speed of the implement 121 in the direction 123*b*, as will be described in further detail below.

In one or more embodiments, the dampener 115 dampens the actuation speed of the downhole tool 100 in the direction 123*a*, the direction 123*b*, or both, thereby ensuring proper actuation of the downhole tool 100 without damaging the downhole tool 100 or other systems/devices associated with the downhole tool 100.

Figure 3:
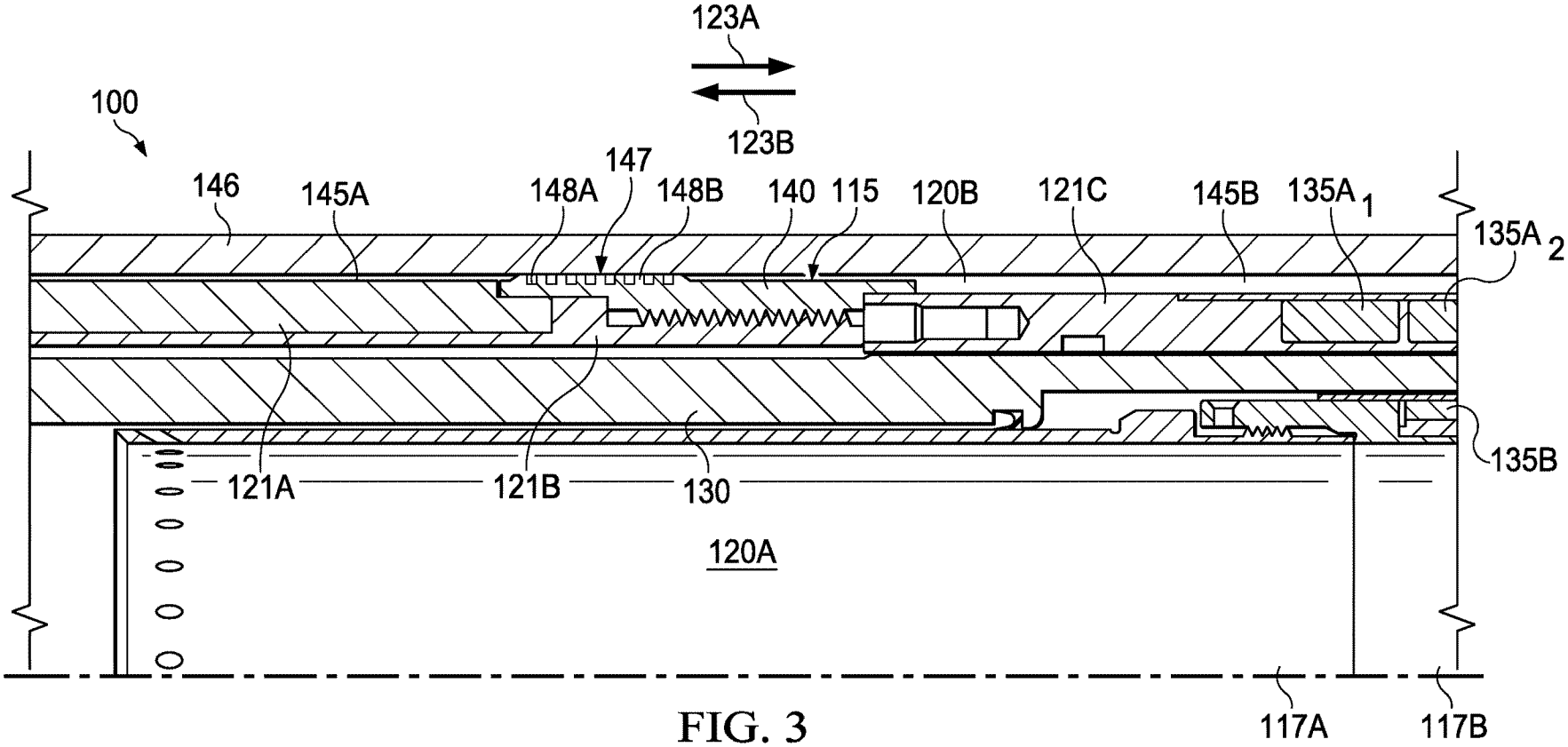
FIG. 3 is a cross-sectional view of the downhole tool of FIGS. 1, 2A, and 2B according to one or more embodiments in which the dampener is or includes a labyrinth seal.

Referring to FIG. 3, in an embodiment, the dampener 115 is or includes a labyrinth seal 140 that slows the actuation speed of the downhole tool 100, which labyrinth seal 140 functions to restrict the flow of a dampening fluid 145, as will be described in further detail below. In one or more embodiments, the labyrinth seal 140 slows the actuation speed of the downhole tool 100 in the direction 123*b* without impacting the actuation speed of the downhole tool 100 in the direction 123*a*. In addition, or instead, the labyrinth seal 140 may be operable to slow the actuation speed of the downhole tool 100 in the direction 123*a* without impacting the actuation speed of the downhole tool 100 in the direction 123*b*. As shown in FIG. 3, the labyrinth seal 140 is disposed within the internal space 120*b* of the downhole tool 100, which internal space 120*b* is or includes an annular space between the internal wall 130 of the downhole tool 10 and an external wall 146.

The implement 121 of the actuation system 110 is also disposed within the internal space 120*b* of the downhole tool 100 and includes interconnected implement segments 121*a-c*. The actuator 122 is connected to the implement segments 121*a* and/or 121*b* to move the implement 121 in the direction 123*a*. Likewise, the biasing device 124 is connected to the implement segment 121*c* to move the implement 121 in the direction 123*b*. The magnetic device 135*a*, including magnets 135*a*1-N, is embedded in or otherwise connected to the implement segment 121*c*. The implement 117 of the FCD 105 is disposed within the internal space 120*a* of the downhole tool 100, which internal space 120*a* is or includes a central flow passage inside the internal wall 120 of the downhole tool 100. The implement 117 includes interconnected implement segments 117*a* and 117*b*. The flow member 116 is connected to the implement segment 117*b* so that, when the implement 117 moves in the direction 123*a* the flow member 116 opens (or closes) the central flow passage, and, when the implement 117 moves in the direction 123*b*, the flow member 116 closes (or opens) the central flow passage. Additionally, the magnetic device 135*b*, including magnets 135*b*1-N, is embedded in or otherwise connected to the implement segment 117*b*.

The labyrinth seal 140 extends circumferentially around the annular space, is externally coupled to the implement 121, and includes an enlarged-diameter external surface 147 into which a plurality of circumferentially-extending and axially-spaced labyrinth grooves 148*a* are formed, thus defining a plurality of circumferentially-extending and axially-spaced labyrinth teeth 148*b* interposed between the labyrinth grooves 148*a*. The enlarged-diameter external surface 147 extends proximate an internal surface of the external wall 146 of the downhole tool 100. The amount of clearance between the enlarged-diameter external surface 147 of the labyrinth seal 140 and the internal surface of the external wall 146 of the downhole tool 100 can be tailored to provide different amounts of "slowing" for different applications.

In operation, when the implement 121 (and thus the labyrinth seal 140) is moved in the direction 123*b*, a portion of the dampening fluid 145 disposed in the internal space 120*b* on the other side 145*a* of the labyrinth seal 140 flows between the labyrinth seal 140 and the internal surface of the external wall 146, past the labyrinth grooves 148*a* and the labyrinth teeth 148*b*, and into the internal space 120*b* on the one side 145*b* of the labyrinth seal 140; in one or more embodiments, the labyrinth seal 140 provides resistance to this flow of the dampening fluid 145, thereby slowing the actuation speed of the implement 121 in the direction 123*b*. Likewise, when the implement 121 (and thus the labyrinth seal 140) is moved in the direction 123*a*, a portion of the dampening fluid 145 disposed in the internal space 120*b* on one side 145*b* of the labyrinth seal 140 flows between the labyrinth seal 140 and the internal surface of the external wall 146, past the labyrinth grooves 148*a* and the labyrinth teeth 148*b*, and into the internal space 120*b* on the other side 145*a* of the labyrinth seal 140; in one or more embodiments, the labyrinth seal 140 provides resistance to this flow of the dampening fluid 145, thereby slowing the actuation speed of the implement 121 in the direction 123*a*.

In one or more embodiments, the labyrinth seal 140 dampens the actuation speed of the downhole tool 100 in the direction 123*a*, the direction 123*b*, or both, thereby ensuring proper actuation of the downhole tool 100 without damaging the downhole tool 100 or other systems/devices associated with the downhole tool 100.

Figure 4A:
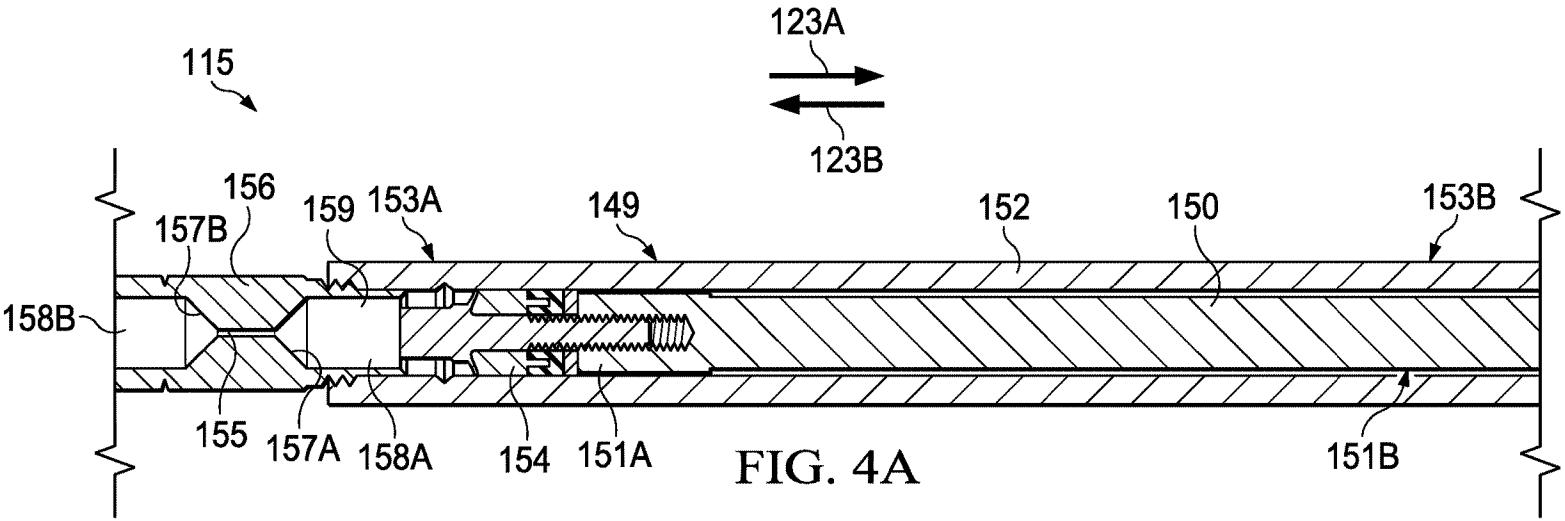
FIG. 4A is a cross-sectional view of the dampener of FIGS. 2A and 2B according to one or more embodiments in which the dampener is or includes a guide rod assembly including a guide rod and an orifice.

Referring to FIG. 4A, in an embodiment, the dampener 115 is or includes a guide rod assembly 149 including a guide rod 150 and an orifice 155. The guide rod 150 defines opposing end portions 151*a* and 151*b* and extends within a guide cylinder 152, which guide cylinder defines opposing end portions 153*a* and 153*b*. A sealing head 154 at the end portion 151*a* of the guide rod 150 sealingly and slidably engages an internal surface of the guide cylinder 152. The end portion 151*b* of the guide rod 150 is connected to the implement 121 of the actuation assembly 110 so that, when the implement 121 moves in the direction 123*a*, the guide rod 150 also moves in the direction 123*a* and, when the implement 121 moves in the direction 123*b*, the guide rod 150 also moves in the direction 123*b*.

The orifice 155 is formed through an orifice tube 156 connected to the guide cylinder 152 at the end portion 153*a*. The orifice 155 opens, along an internal tapered (e.g., frustoconical) surface 157*a* into an enlarged-diameter internal passage 158*a* of the orifice tube 156 on a side of the orifice tube 156 adjacent the guide cylinder 152. Likewise, the orifice 155 opens, along an internal tapered (e.g., frustoconical) surface 157*b* into an enlarged-diameter internal passage 158*b* of the orifice tube 156 on a side of the orifice tube 156 opposite the guide cylinder 152.

A dampening fluid 159 is disposed within the enlarged-diameter internal passage 158*a*, the orifice 155, and the enlarged-diameter internal passage 158*b*. In operation, when the implement 121 (and thus the guide rod 150) is moved in the direction 123*b*, a portion of the dampening fluid 159 disposed within the enlarged-diameter internal passage 158*a* on the side of the orifice 155 adjacent the guide cylinder 152 flows along the internal tapered surface 157*a*, through the orifice 155, and into the enlarged-diameter internal passage 158*b*; in one or more embodiments, the orifice 155 provides resistance to this flow of the dampening fluid 159, thereby slowing the actuation speed of the implement 121 in the direction 123*b*. Likewise, when the implement 121 (and thus the guide rod 150) is moved in the direction 123*a*, a portion of the dampening fluid 159 disposed within the enlarged-diameter internal passage 158*b* on the side of the orifice 155 opposite the guide cylinder 152 flows along the internal tapered surface 157*b*, through the orifice 155, and into the enlarged-diameter internal passage 158*a*; in one or more embodiments, the orifice 155 provides resistance to this flow of the dampening fluid 159, thereby slowing the actuation speed of the implement 121 in the direction 123*a*.

In one or more embodiments, the guide rod assembly 149 dampens the actuation speed of the downhole tool 100 in the direction 123*a*, the direction 123*b*, or both, thereby ensuring proper actuation of the downhole tool 100 without damaging the downhole tool 100 or other systems/devices associated with the downhole tool 100.

In one or more embodiments, the dampener 115 is or includes the guide rod assembly 149 and one or more additional guide rod assembl(ies) substantially identical to the guide rod assembly 149, each connected to the implement 121, and collectively distributed around a circumference of the internal wall 130 within the annular space.

Figure 4B:
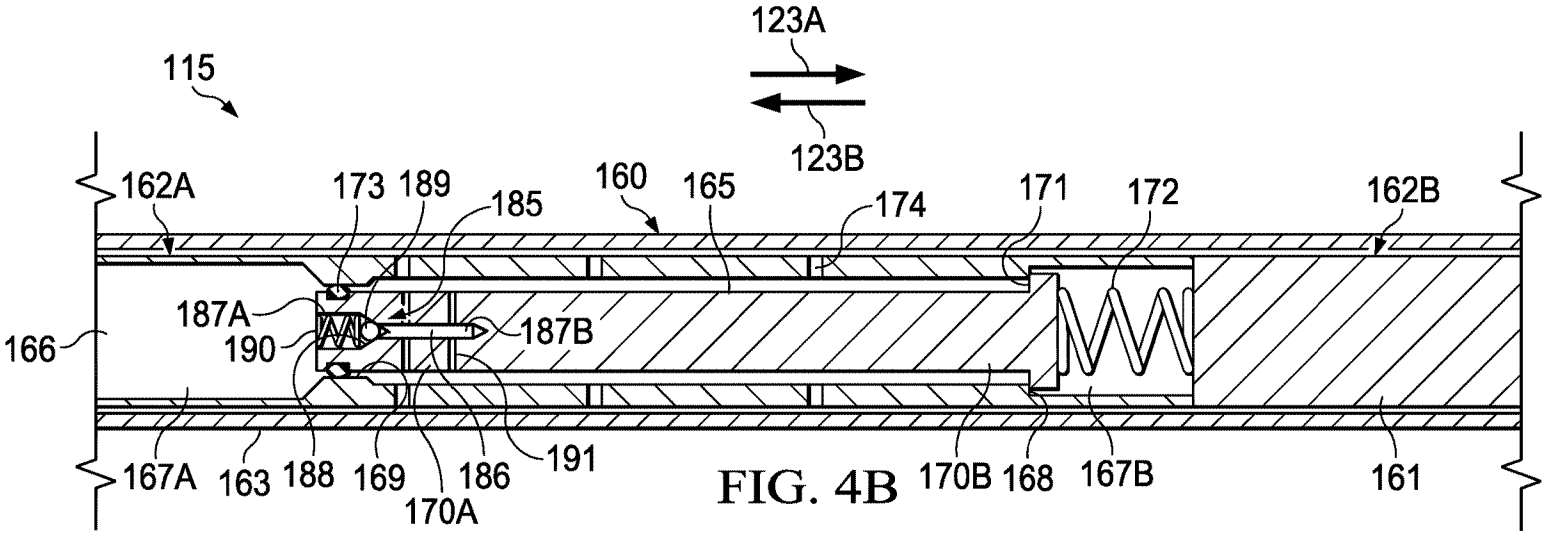
FIG. 4B is a cross-sectional view of the dampener of FIGS. 2A and 2B according to one or more embodiments in which the dampener is or includes a guide rod assembly including a guide rod with an integral pressure relief member and a secondary miniature relief valve.

Referring to FIG. 4B, in an embodiment, the dampener 115 is or includes a guide rod assembly 160 including a guide rod 161 with an integral pressure relief member 165. The guide rod 161 defines opposing end portions 162*a* and 162*b* and extends within a guide cylinder 163. A sealing head (not shown; substantially identical to the sealing head 154 described above in connection with FIG. 4A) at the end portion 162*a* of the guide rod 161 sealingly and slidably engages an internal surface of the guide cylinder 163. The end portion 162*b* of the guide rod 161 is connected to the implement 121 of the actuation assembly 110 so that, when the implement 121 moves in the direction 123*a*, the guide rod 161 also moves in the direction 123*a* and, when the implement 121 moves in the direction 123*b*, the guide rod 161 also moves in the direction 123*b*.

The integral pressure relief member 165 extends within an internal cavity 166 of the guide rod 161, which internal cavity 166 defines opposing end portions 167*a* and 167*b*. The guide rod 161 includes an internal shoulder 168 defined by the internal cavity 166 and facing the end portion 167*b*. The guide rod 161 also includes a reduced-diameter internal surface 169 proximate the end portion 167*a* of the internal cavity 166. The integral pressure relief member 165 defines opposing end portions 170*a* and 170*b*. An external shoulder 171 is formed in the integral pressure relief member 165 at the end portion 170*b*, facing the end portion 170*a*. The external shoulder 171 of the integral pressure relief member 165 is adapted to engage the internal shoulder 168 of the guide rod 161. More particularly, a biasing member such as, for example, a spring 172 urges the external shoulder 171 of the integral pressure relief member 165 into engagement with the internal shoulder 168 of the guide rod 161. A seal 173 is sealingly engaged between the end portion 170*a* of the integral pressure relief member 165 and the reduced-diameter internal surface 169 of the guide rod 161 when the external shoulder 171 of the integral pressure relief member 165 engages the internal shoulder 168 of the guide rod 161.

The integral pressure relief member 165 is activated based on an increase in back-pressure during actuation of the downhole tool 100 in the direction 123*b*. More particularly, activation of the integral pressure relief member 165 occurs when the back-pressure within the end portion 167*a* of the internal cavity 166 urges the integral pressure relief member 165 in the direction 123*a*, relative to the guide rod 161, and against the spring 172. When the back-pressure within the end portion 167*a* of the internal cavity 166 overcomes the biasing force imparted to the integral pressure relief member 165 by the spring 172, the integral pressure relief member 165 moves in the direction 123*a* and relative to the guide rod 161, disengaging the sealing engagement of the seal 173 between the end portion 170*a* of the integral pressure relief member 165 and the reduced-diameter internal surface 169 of the guide rod 161. This disengagement of the seal 173 opens fluid communication between the end portion 167*a* of the internal cavity 166 and the end portion 167*b* of the internal cavity 166. One or more ports 174 are formed radially through the guide rod 161 from the end portion 167*b* of the internal cavity 166. As a result, when the seal 173 is disengaged by an increase in back-pressure during actuation of the downhole tool 100 in the direction 123*b*, a dampening fluid 180 bypasses the integral pressure relief member 165, flowing from the end portion 167*a* of the internal cavity 166, into the end portion 167*b* of the internal cavity 166, and through the port(s) 174; in one or more embodiments, the integral pressure relief member 165 resists this flow of the dampening fluid 180, thereby slowing the actuation speed of the implement 121 in the direction 123*b*.

In addition, or instead, the guide rod 161 may include a secondary miniature relief valve 185 operable to alleviate pressure buildup when the downhole tool 100 is actuated in the direction 123*a*. The secondary miniature relief valve 185 extends within an internal cavity 186 of the integral pressure relief member 165, which internal cavity 186 defines opposing end portions 187*a* and 187*b*. The end portion 187*a* of the internal cavity 186 has an enlarged diameter, and the end portion 187*b* of the internal cavity 186 has a reduced diameter. An internal tapered (e.g., frustoconical) surface 188 extends between the end portion 187*a* of the internal cavity 186 (having the enlarged diameter) and the end portion 187*b* of the internal cavity 186 having the reduced diameter, facing the end portion 187*a* of the internal cavity 186 having the enlarged diameter. A pressure relief member 189 is urged into sealing engagement with the internal tapered surface 188 by a biasing member such as, for example, a spring 190.

The secondary miniature relief valve 185 is activate based on an increase in backpressure during actuation of the downhole tool 100 in the direction 123*a*. More particularly, activation of the secondary miniature relief valve 185 occurs when the back-pressure within the end portion 187*b* of the internal cavity 186 urges the pressure relief member 189 in the direction 123*b*, relative to the integral pressure relief member 165, and against the spring 190. When the back-pressure within the end portion 187*b* the internal cavity 186 overcomes the biasing force imparted to the pressure relief member 189 by the spring 190, the pressure relief member 189 moves in the direction 123*b* and relative to the integral pressure relief member 165, disengaging the sealing engagement of the pressure relief member 189 from the internal tapered surface 188 of the integral pressure relief member 165. This disengagement of the pressure relief member 189 opens fluid communication between the end portion 187*b* of the internal cavity 186 and the end portion 187*a* of the internal cavity 186.

One or more ports 191 are formed radially through the integral pressure relief member 165 from the end portion 187*a* of the internal cavity 186. As a result, when the pressure relief member 189 is disengaged by an increase in back-pressure during actuation of the downhole tool 100 in the direction 123*a*, the dampening fluid 180 bypasses the pressure relief member 189, flowing through the port(s) 174, into the end portion 167*b* of the internal cavity 166, through the port(s) 191, into the end portion 187*b* of the internal cavity 186, past the pressure relief member 189, into the end portion 187*a* of the internal cavity 186, and into the end portion 167*a* of the internal cavity 166; in one or more embodiments, the pressure relief member 189 resists this flow of the dampening fluid 180, thereby slowing the actuation speed of the implement 121 in the direction 123*a*. More particularly, in such embodiments, the secondary miniature relief valve 185 slows the actuation speed of the downhole tool 100 in the direction 123*a* (e.g., during opening of the downhole tool 100, thereby preventing a pressure lock), and the integral pressure relief member 165 slows the actuation speed of the downhole tool 100 in the direction 123*b* (e.g., during closing of the downhole tool 100).

In one or more embodiments, the guide rod assembly 160 dampens the actuation speed of the downhole tool 100 in the direction 123*a*, the direction 123*b*, or both, thereby ensuring proper actuation of the downhole tool 100 without damaging the downhole tool 100 or other systems/devices associated with the downhole tool 100.

In one or more embodiments, the dampener 115 is or includes the guide rod assembly 160 and one or more additional guide rod assembl(ies) substantially identical to the guide rod assembly 160, each connected to the implement 121, and collectively distributed around a circumference of the internal wall 130 within the annular space.

Figure 5A:
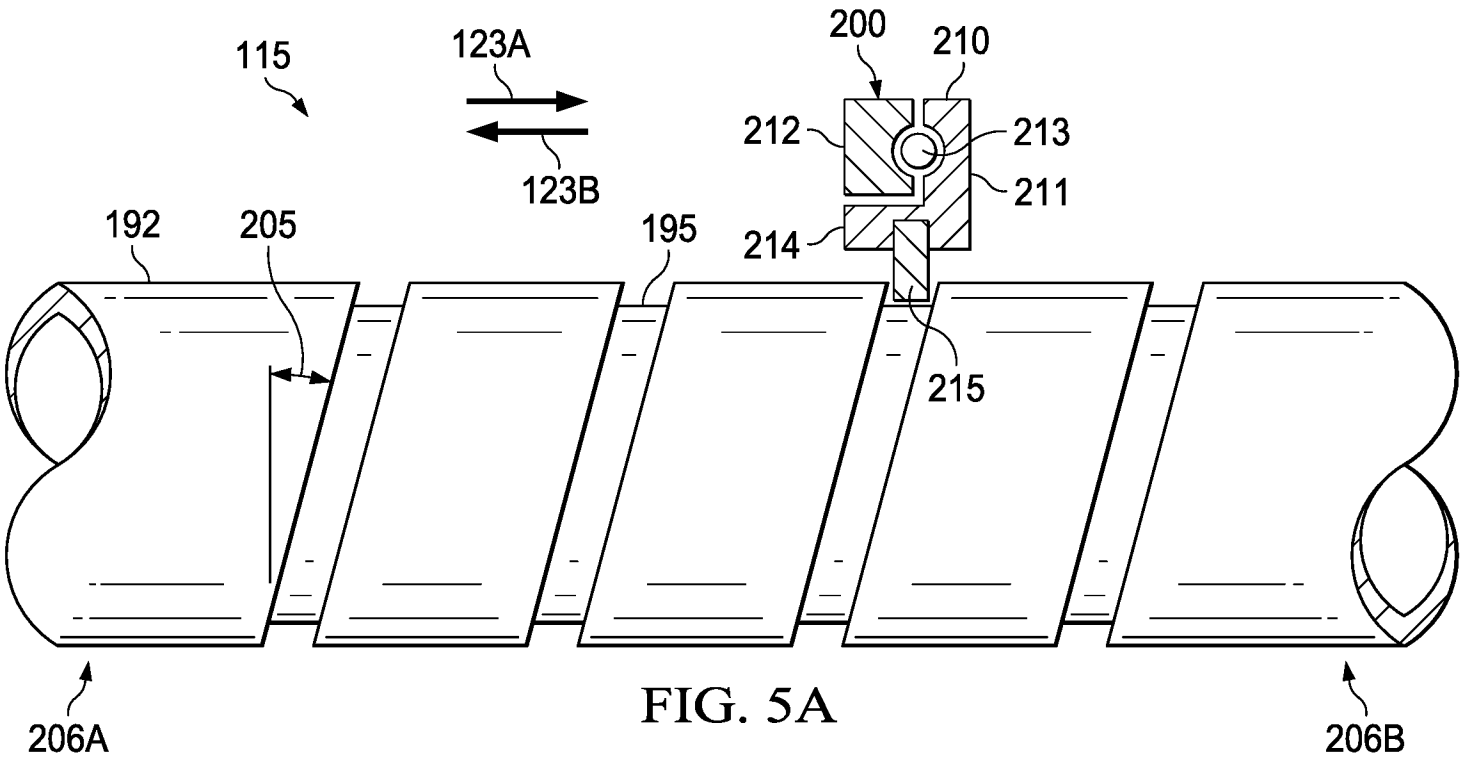
FIG. 5A is a partial cross-sectional view of the dampener of FIGS. 2A and 2B according to one or more embodiments in which the dampener is or includes a sleeve having a slot such as, for example, a helical slot formed therein, and a guide adapted to engage the helical slot.

Referring to FIG. 5A, in an embodiment, the dampener 115 is or includes a sleeve 192 having a slot such as, for example, a helical slot 195 formed therein, and a guide 200 adapted to engage the helical slot 195. The helical slot 195 defines a pitch angle 205 that determines the actuation speed of the downhole tool 100 in both the direction 123*a* and the direction 123*b*. The sleeve 192 extends within the internal space 120*b* (shown in FIGS. 2A, 2B, and 3) of the downhole tool 100 and defines opposing end portions 206*a* and 206*b*. The end portion 206*b* of the sleeve 192 is connected to the implement 121 (shown in FIGS. 2A and 2B) of the actuation assembly 110 so that, when the implement 121 moves in the direction 123*a*, the sleeve 192 also moves in the direction 123*a* and, when the implement 121 moves in the direction 123*b*, the sleeve 192 also moves in the direction 123*b*. The helical slot 195 is formed externally into the sleeve 192. The guide 200 includes a bearing assembly 210 having a rotating component 211 and a stationary component 212. The stationary component 212 is connected to or otherwise operably associated with the external wall 146 (shown in FIG. 3) of the downhole tool 100. The rotating component 211 is rotatable relative to the stationary component 212, via a bearing component 213, and includes a body 214 and a pin 215 extending radially inwardly from the body 214. The pin 215 extends into, and is adapted to ride along, the helical slot 195 in the sleeve 192.

In operation, when the implement 121 (and thus the sleeve 192) is moved in the direction 123*a*, the pin 215 rides along the helical slot 195, causing the rotating component 211 of the bearing assembly 210 to rotate relative to the stationary component 212, via the bearing component 213, and slowing the actuation speed of the downhole tool 100 in the direction 123*a*. The pitch angle 205 can be tailored to provide different amounts of "slowing" for different applications. Similarly, when the implement 121 (and thus the sleeve 192) is moved in the direction 123*b*, the pin 215 rides along the helical slot 195 in the opposite direction, causing the rotating component 211 of the bearing assembly 210 to rotate relative to the stationary component 212, via the bearing component 213, and slowing the actuation speed of the downhole tool 100 in the direction 123*b*.

In one or more embodiments, the sleeve 192 and the guide 200, in combination, dampen the actuation speed of the downhole tool 100 in the direction 123*a*, the direction 123*b*, or both, thereby ensuring proper actuation of the downhole tool 100 without damaging the downhole tool 100 or other systems/devices associated with the downhole tool 100.

Although described as being formed externally into the sleeve 192, the helical slot 195 may instead be formed internally into the sleeve 192; in such embodiments, rather than being connected to or otherwise operably associated with the external wall 146 of the downhole tool 100, the stationary component 212 of the bearing assembly 210 is connected to or otherwise operably associated with the internal wall 130 of the downhole tool 100, so that the pin 215 of the rotating component 211 extends radially inwardly into the helical slot 195 formed internally into the sleeve 192.

Figure 5B:
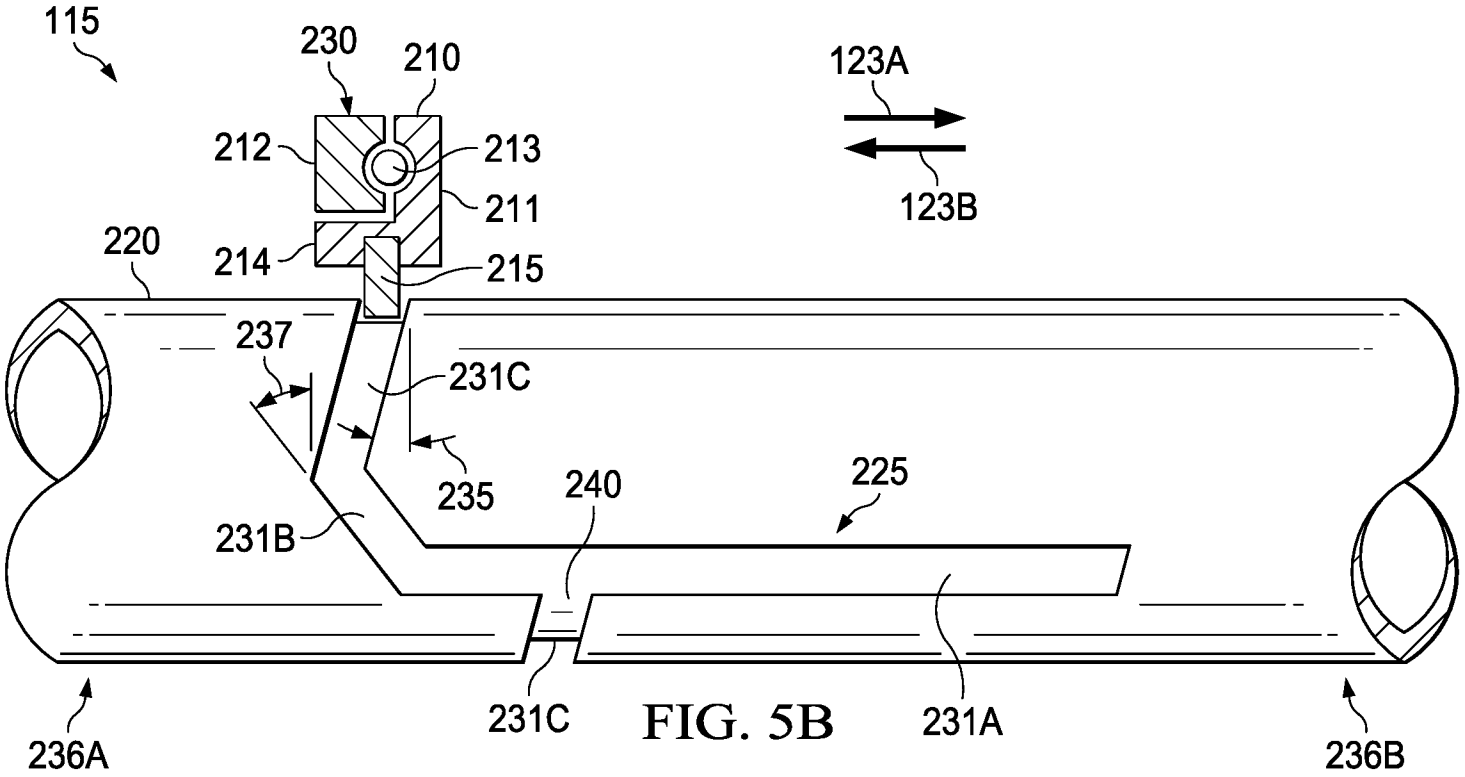
FIG. 5B is a partial cross-sectional view of the dampener of FIGS. 2A and 2B according to one or more embodiments in which the dampener is or includes a sleeve having a slot such as, for example, a J-slot formed therein, and a guide adapted to engage the J-slot.

Referring to FIG. 5B, in an embodiment, the dampener 115 is or includes a sleeve 220 having a slot such as, for example, a J-slot 225 formed therein, and a guide 230 adapted to engage the J-slot 225. The J-slot 225 includes a straight portion 231*a*, a transitional portion 231*b*, and a helical portion 231*c*. The helical portion 231*c* of the J-slot 225 defines a pitch angle 235. The sleeve 220 extends within the internal space 120*b* (shown in FIGS. 2A, 2B, and 3) of the downhole tool 100 and defines opposing end portions 236*a* and 236*b*. The end portion 236*b* of the sleeve 220 is connected to the implement 121 (shown in FIGS. 2A and 2B) of the actuation assembly 110 so that, when the implement 121 moves in the direction 123*a*, the sleeve 220 also moves in the direction 123*a* and, when the implement 121 moves in the direction 123*b*, the sleeve 220 also moves in the direction 123*b*. The J-slot 225 is formed externally into the sleeve 220. The guide 230 is substantially identical to the guide 200 and therefore, will not be described in further detail; more particularly, the guide 230 includes feature(s)/component(s) substantially identical to corresponding feature(s)/component(s) of the guide 200, which substantially identical feature(s)/component(s) are given the same reference numerals. The pin 215 of the guide 230 extends into, and is adapted to ride along, the J-slot 225 in the sleeve 220.

In operation, when the implement 121 (and thus the sleeve 220) is moved in the direction 123*a*, the pin 215 rides along the straight portion 231*a* of the J-slot 225, so that the rotating component 211 of the bearing assembly 210 does not rotate relative to the stationary component 212, via the bearing component 213, and the actuation speed of the downhole tool 100 in the direction 123*a* is not slowed. The transitional portion 231*b* of the J-slot 225 connects the straight portion 231*a* to the helical portion 231*c*, defining a pitch angle 237. As the pin 215 nears the end portion 236*a* of the sleeve 220, the pin 215 exits the straight portion 231*a* of the J-slot 225 and passes through the transitional portion 231*b*, into the helical portion 231*c*. The pitch angle 237 of the transitional portion 231*b* slows the actuation speed of the downhole tool in the direction 123*a*, at least when the pin 215 extends within the transitional portion 231*b*, causing the rotating component 211 of the bearing assembly 210 to rotate relative to the stationary component 212, via the bearing component 213. The pitch angle 237 of the transitional portion 231*b* can be tailored for different applications to provide different amounts of "slowing" while the downhole tool 100 is actuated in the direction 123*a* and the pin 215 extends within the transitional portion 231*b* of the J-slot 225. Once the pin 215 enters the helical portion 231*c* of the J-slot 225, the implement 121 (and thus the sleeve 220) may be moved in the direction 123*b*, causing the pin 215 to ride along the helical portion 231*c* of the J-slot 225 in the opposite direction. As the pin 215 rides along the helical portion 231*c* of the J-slot 225 in the opposite direction, the rotating component 211 of the bearing assembly 210 rotates relative to the stationary component 212, via the bearing component 213, slowing the actuation speed of the downhole tool 100 in the direction 123*b*, at least until the pin 215 re-enters the straight portion 231*a* of the J-slot 225 at an intersection 240 between the helical portion 231*c* and the straight portion 231*a*, at which point the actuation speed of the downhole tool 100 in the direction 123*b* is no longer slowed. The pitch angle 235 of the helical portion 231*c* of the J-slot 225 can be tailored for different applications to provide different amounts of "slowing" while downhole tool is actuated in the direction 123*b* and the pin 215 extends within the helical portion 231*c* of the J-slot 225.

In one or more embodiments, the sleeve 220 and the guide 230, in combination, dampen the actuation speed of the downhole tool 100 in the direction 123*a*, the direction 123*b*, or both, thereby ensuring proper actuation of the downhole tool 100 without damaging the downhole tool 100 or other systems/devices associated with the downhole tool 100.

Although described as being formed externally into the sleeve 220, the J-slot 225 may instead be formed internally into the sleeve 220; in such embodiments, rather than being connected to or otherwise operably associated with the external wall 146 of the downhole tool 100, the stationary component 212 of the bearing assembly 210 is connected to or otherwise operably associated with the internal wall 130 of the downhole tool 100, so that the pin 215 of the rotating component 211 extends radially inwardly into the J-slot 225 formed internally into the sleeve 220.

A downhole tool has been disclosed. The downhole tool generally includes: a first implement; an actuator adapted to actuate the first implement in a first direction; a biasing device adapted to actuate the first implement in a second direction, opposite the first direction; a dampener adapted to slow an actuation speed of the first implement in the first direction, the second direction, or both; and a flow control device ("FCD") including a flow member and a second implement to which the first implement is connected; wherein actuating the first implement in the first direction also actuates the second implement in the first direction to place the flow member in a first configuration; and wherein actuating the first implement in the second direction also actuates the second implement in the second direction to place the flow member in a second configuration. In one or more embodiments, the first configuration in which the flow member is placed when the second implement is actuated in the first direction is or includes an open configuration in which the flow member permits fluid flow through the downhole tool; and the second configuration in which the flow member is placed when the second implement is actuated in the second direction is or includes a closed configuration in which the flow member prevents, or at least reduces, fluid flow through the downhole tool. In one or more embodiments, the FCD extends within a first internal space of the downhole tool; the first implement, the actuator, the biasing device, and the dampener extend within a second internal space of the downhole tool; and the second internal space is external to the first internal space. In one or more embodiments, the second internal space is separated from the first internal space by an internal wall of the downhole tool; the first internal space is or includes a central flow passageway of the downhole tool; and the second internal space is or includes an annular space of the downhole tool located between the internal wall and an external wall of the downhole tool. In one or more embodiments, the dampener is or includes a labyrinth seal. In one or more embodiments, the dampener is or includes a guide rod assembly, the guide rod assembly including a guide rod and: an orifice; or an integral pressure relief member. In one or more embodiments, the guide rod assembly includes: the guide rod; the integral pressure relief member; and a secondary miniature relief valve. In one or more embodiments, the dampener is or includes a sleeve having a slot and formed therein, and a guide adapted to engage the slot. In one or more embodiments, at least a portion of the slot is helical. In one or more embodiments, the slot is or includes a J-slot.

A method has also been disclosed. The method generally includes: actuating, using an actuator of a downhole tool, a first implement in a first direction; actuating, using a biasing device of the downhole tool, the first implement in a second direction, opposite the first direction; and slowing, using a dampener of the downhole tool, an actuation speed of the first implement in the first direction, the second direction, or both. In one or more embodiments, actuating the first implement in the first direction also actuates a second implement of a flow control device ("FCD") of the downhole tool, to which the first implement is connected, in the first direction, placing a flow member of the FCD, to which the second implement is connected, in a first configuration; and actuating the first implement in the second direction also actuates the second implement of the FCD in the second direction, placing the flow member in a second configuration. In one or more embodiments, the first configuration in which the flow member is placed when the second implement is actuated in the first direction is or includes an open configuration in which the flow member permits fluid flow through the downhole tool; and the second configuration in which the flow member is placed when the second implement is actuated in the second direction is or includes a closed configuration in which the flow member prevents, or at least reduces, fluid flow through the downhole tool.

An apparatus has also been disclosed. The apparatus generally includes: an implement; an actuator adapted to actuate the implement in a first direction; a biasing device adapted to actuate the implement in a second direction, opposite the first direction; and a dampener adapted to slow an actuation speed of the implement in the first direction, the second direction, or both. In one or more embodiments, the dampener is or includes a labyrinth seal. In one or more embodiments, the dampener is or includes a guide rod assembly, the guide rod assembly including a guide rod and: an orifice; or an integral pressure relief member. In one or more embodiments, the guide rod assembly includes: the guide rod; the integral pressure relief member; and a secondary miniature relief valve. In one or more embodiments, the dampener is or includes a sleeve having a slot and formed therein, and a guide adapted to engage the slot. In one or more embodiments, at least a portion of the slot is helical. In one or more embodiments, the slot is or includes a J-slot.

It is understood that variations may be made in the foregoing without departing from the scope of the present disclosure.

In several embodiments, the elements and teachings of the various embodiments may be combined in whole or in part in some (or all) of the embodiments. In addition, one or more of the elements and teachings of the various embodiments may be omitted, at least in part, and/or combined, at least in part, with one or more of the other elements and teachings of the various embodiments.

Any spatial references, such as, for example, "upper," "lower," "above," "below," "between," "bottom," "vertical," "horizontal," "angular," "upwards," "downwards," "side-to-side," "left-to-right," "right-to-left," "top-to-bottom," "bottom-to-top," "top," "bottom," "bottom-up," "top-down," etc., are for the purpose of illustration only and do not limit the specific orientation or location of the structure described above.

In several embodiments, while different steps, processes, and procedures are described as appearing as distinct acts, one or more of the steps, one or more of the processes, and/or one or more of the procedures may also be performed in different orders, simultaneously and/or sequentially. In several embodiments, the steps, processes, and/or procedures may be merged into one or more steps, processes and/or procedures.

In several embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although several embodiments have been described in detail above, the embodiments described are illustrative only and are not limiting, and those skilled in the art will readily appreciate that many other modifications, changes and/or substitutions are possible in the embodiments without materially departing from the novel teachings and advantages of the present disclosure. Accordingly, all such modifications, changes, and/or substitutions are intended to be included within the scope of this disclosure as defined in the following claims. In the claims, any means-plus-function clauses are intended to cover the structures described herein as performing the recited function and not only structural equivalents, but also equivalent structures. Moreover, it is the express intention of the applicant not to invoke 35 U.S.C. § 112(f) for any limitations of any of the claims herein, except for those in which the claim expressly uses the word "means" together with an associated function.

What is claimed is:

1. A downhole tool, comprising:

a first implement;

an actuator adapted to actuate the first implement in a first direction;

a biasing device adapted to actuate the first implement in a second direction, opposite the first direction;

a dampener adapted to slow an actuation speed of the first implement in the first direction, the second direction, or both wherein:

the dampener is or includes a guide rod assembly including a guide rod, and an orifice or an integral pressure relief member; or the dampener is or includes a sleeve having a slot formed therein, and a guide adapted to engage the slot; and a flow control device ("FCD") including a flow sleeve and a second implement to which the first implement is connected;

wherein actuating the first implement in the first direction also actuates the second implement in the first direction to place the flow sleeve in a first configuration; and wherein actuating the first implement in the second direction also actuates the second implement in the second direction to place the flow sleeve in a second configuration.

2. The downhole tool of claim 1, wherein the first configuration in which the flow sleeve is placed when the second implement is actuated in the first direction is or includes an open configuration in which the flow sleeve permits fluid flow through the downhole tool; and wherein the second configuration in which the flow sleeve is placed when the second implement is actuated in the second direction is or includes a closed configuration in which the flow sleeve prevents, or at least reduces, fluid flow through the downhole tool.

3. The downhole tool of claim 1, wherein the FCD extends within a first internal space of the downhole tool;

wherein the first implement, the actuator, the biasing device, and the dampener extend within a second internal space of the downhole tool; and wherein the second internal space is external to the first internal space.

4. The downhole tool of claim 3, wherein the second internal space is separated from the first internal space by an internal wall of the downhole tool;

wherein the first internal space is or includes a central flow passageway of the downhole tool; and wherein the second internal space is or includes an annular space of the downhole tool located between the internal wall and an external wall of the downhole tool.

5. The downhole tool of claim 1, wherein the dampener is or includes a labyrinth seal.

6. The downhole tool of claim 1, wherein the guide rod assembly comprises:

the guide rod;

the integral pressure relief member; and a secondary miniature relief valve.

7. The downhole tool of claim 1, wherein at least a portion of the slot is helical.

8. The downhole tool of claim 1, wherein the second implement is integrally formed with the first implement.

9. A method, comprising:

actuating, using an actuator of a downhole tool, a first implement in a first direction, wherein actuating the first implement in the first direction also actuates a second implement of a flow control device ("FCD") of the downhole tool, to which the first implement is connected, in the first direction, placing a flow sleeve of the FCD, to which the second implement is connected, in a first configuration;

actuating, using a biasing device of the downhole tool, the first implement in a second direction, opposite the first direction, wherein actuating the first implement in the second direction also actuates the second implement of the FCD in the second direction, placing the flow sleeve in a second configuration; and slowing, using a dampener of the downhole tool, an actuation speed of the first implement in the first direction, the second direction, or both wherein:

the dampener is or includes a guide rod assembly including a guide rod, and an orifice or an integral pressure relief member; or the dampener is or includes a sleeve having a slot formed therein, and a guide adapted to engage the slot.

10. The method of claim 9, wherein the first configuration in which the flow sleeve is placed when the second implement is actuated in the first direction is or includes an open configuration in which the flow sleeve permits fluid flow through the downhole tool; and wherein the second configuration in which the flow sleeve is placed when the second implement is actuated in the second direction is or includes a closed configuration in which the flow sleeve prevents, or at least reduces, fluid flow through the downhole tool.

11. An apparatus, comprising:

a first implement;

an actuator adapted to actuate the first implement in a first direction;

a biasing device adapted to actuate the first implement in a second direction, opposite the first direction;

a dampener adapted to slow an actuation speed of the first implement in the first direction, the second direction, or both wherein:

the dampener is or includes a guide rod assembly including a guide rod, and an orifice or an integral pressure relief member; or the dampener is or includes a sleeve having a slot formed therein, and a guide adapted to engage the slot; and a flow control device ("FCD") including a flow sleeve and a second implement to which the first implement is connected, the flow sleeve and the second implement configured to move in unison with the first implement.

12. The apparatus of claim 11, wherein the dampener is or includes a labyrinth seal.

13. The apparatus of claim 11, wherein the guide rod assembly comprises:

the guide rod;

the integral pressure relief member; and a secondary miniature relief valve.

14. The apparatus of claim 11, wherein at least a portion of the slot is helical.

15. The apparatus of claim 14, wherein the slot is or includes a J-slot.

* * * * *